US005233925A

United States Patent [19]

Föhl

[11] Patent Number: 5,233,925

[45] Date of Patent: Aug. 10, 1993

[54] PERCUSSION IGNITER FOR A PYROTECHNICAL GAS GENERATOR PROVIDED WITH A PRIMING CAP

[75] Inventor: Artur Föhl, Schorndorf, Fed. Rep. of Germany

[73] Assignee: TRW Repa GmbH, Alfdorf, Fed. Rep. of Germany

[21] Appl. No.: 850,448

[22] Filed: Mar. 10, 1992

[30] Foreign Application Priority Data

Mar. 25, 1991 [DE] Fed. Rep. of Germany ..... 9103660

[51] Int. Cl.[5] ..... F42C 19/10

[52] U.S. Cl. ..... 102/204; 102/469; 280/733

[58] Field of Search ..... 102/204, 470, 469; 280/733, 741, 736

[56] References Cited

U.S. PATENT DOCUMENTS

| | | | |
|---|---|---|---|
| 120,196 | 10/1871 | Hobbs et al. | 102/470 |
| 2,592,623 | 4/1952 | Turnbull | 102/430 |
| 2,669,929 | 2/1954 | Shull et al. | 102/204 |
| 2,708,409 | 5/1955 | Borcher | 102/204 |
| 2,715,365 | 8/1955 | Godchaux et al. | 102/204 |
| 3,638,964 | 2/1972 | Chute | 280/736 |
| 3,706,463 | 12/1972 | Lipkin | 280/733 |
| 3,732,820 | 5/1973 | Hendricks | 102/470 |
| 3,822,896 | 7/1974 | Hallberg | 280/733 |
| 3,855,900 | 12/1974 | Barr et al. | 89/156 |
| 4,049,935 | 9/1977 | Gruber | 280/736 |
| 4,421,031 | 12/1983 | Carter et al. | 102/252 |
| 4,686,905 | 8/1987 | Szabo | 102/444 |

FOREIGN PATENT DOCUMENTS

| | | | |
|---|---|---|---|
| 91698 | 2/1896 | Fed. Rep. of Germany . | |
| 913137 | 8/1954 | Fed. Rep. of Germany . | |
| 3413484 | 1/1986 | Fed. Rep. of Germany . | |
| 1056737 | 3/1954 | France . | |
| 2246841 | 5/1975 | France . | |
| 132447 | 6/1991 | Japan | 280/736 |

OTHER PUBLICATIONS

European Search Report EP 92 10 2830.

Patent Abstracts of Japan, vol. 4, No. 143 (M-811), Apr. 7, 1989 and JP-A-63 306 951 (Honda Motor Co.) Dec. 14, 1988.

*Primary Examiner*—Stephen M. Johnson

*Attorney, Agent, or Firm*—Tarolli, Sundheim & Covell

[57] ABSTRACT

A percussion igniter for a pyrotechnical gas generator in a safety belt pretensioner is provided. The gas generator has a housing with a guide opening. An impact transmission member such as a ball or pin is received in the guide opening and has an inner end facing an impact face of a priming cap in said gas generator and an outer end projecting from the guide opening.

16 Claims, 1 Drawing Sheet

PERCUSSION IGNITER FOR A PYROTECHNICAL GAS GENERATOR PROVIDED WITH A PRIMING CAP

BACKGROUND OF THE INVENTION

The invention relates to a percussion igniter for a pyrotechnical gas generator provided with a priming cap in a restraining system for vehicle occupants.

In mechanical triggering of a pyrotechnical gas generator cartridge by the action of an impact the center of the priming cap must be hit very precisely to ensure reliable triggering. The gas generator is normally supplied as a self-contained unit which has an exposed striking surface on the priming cap. If a striking pin is used to transmit the blow to the priming cap a guide opening must be provided in the mechanical component facing the priming cap to hold and guide the pin precisely in alignment with the center of the striking surface on the priming cap. This requirement can be met only by narrow component and assembly tolerances.

SUMMARY OF THE INVENTION

The present invention provides a percussion igniter which ensures reliable ignition even without maintaining narrow assembly and component tolerances.

This is achieved according to the invention with a percussion igniter wherein an impact transmission element is accommodated in a guide opening of the gas generator housing opposite an impact surface of a priming cap and projecting with its free end out of the guide opening. The guide opening aligns the impact transmission element precisely centrally with respect to the priming or firing cap and holds said element in that position. Consequently, an impact on the projecting free end of the impact transmission element results in certain ignition. The blow or impact now need not be guided centrally in the axis of the priming cap; on the contrary, it suffices for a blunt impact member, an anvil, lever or the like, to strike the free end of the impact transmission element.

The advantages achieved with the invention manifest themselves particularly when the gas generator on the one hand and the impact member exerting the blow on the impact transmission element on the other hand are arranged in two assemblies of a belt pretensioner in a safety belt system, said assemblies being movable with respect to each other. For example, the gas generator can be accommodated in a displaceable block of a belt pretensioner engaging the buckle of the safety belt system. In such an arrangement the exact alignment of the priming cap on the gas generator with respect to a striking pin guided in a stationary member would require high component and assembly tolerance. In contrast, with the embodiment of the percussion igniter according to the invention reliable triggering is ensured even when the striking pin or another member executing the impact is offset by several millimeters with respect to the axis of the gas generator.

In the preferred embodiment of the percussion igniter the impact transmission element is a ball. The introduction of a ball into the guide opening of the gas generator housing does not require any aligning or adjustment at all and is therefore favourable for automation of the production.

BRIEF DESCRIPTION OF THE DRAWINGS

Further features and advantages of the invention will be apparent from the following description and the drawings, to which reference is made and in which.

DESCRIPTION OF PREFERRED EMBODIMENTS

Figure 1:
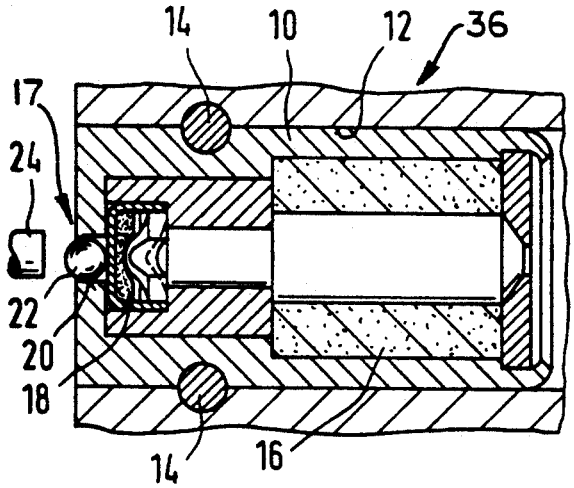
FIG. 1 shows an axial section of a pyrotechnical gas generator with a percussion igniter.

In the embodiment shown in FIG. 1 a cylindrical housing 10 of a pyrotechnical gas generator 36 is inserted into a bore 12 of an aggregate, which may for example be a pretensioner in a vehicle safety belt system. The housing 10 of the gas generator 36 is secured in the bore 12 by two pins 14. The gas generator 36 is provided with a pyrotechnical charge 16 and a percussion igniter 17. The percussion igniter 17 includes a priming cap 18. The pyrotechnical charge 16 and the priming cap 18 are conventionally constructed and will therefore not be described in detail. The housing 10 of the gas generator 36 comprises opposite the central region of the impact surface of the priming cap 18 a guide opening 20 in which a ball 22, of the percussion igniter 17, is received. The ball 22 projects out of the guide opening 20 which is narrowed at its outer end, for example by calking, so that the ball 22 is held therein. A blunt end of an impact or striking member 24 is located opposite to the end of the ball 22 projecting out of the guide opening 20. The striking member 27 is part of a mechanical triggering means. An end surface area of the striking member is substantially greater than the end of the ball 22. On activation, the striking member 24, which may also be an interposed striking pin, is driven against the ball 22. The ball 22 impacts exactly centrally into an impact surface of the priming cap 18, thereby igniting the gas generator 36. It is apparent that the axis of the striking member 24 need in no way align exactly with the gas generator 36; on the contrary, it is only necessary for the blunt end surface of the striking member 24 to strike the projecting portion of the ball 22. The ball 22 forms an impact transmission element which is aligned precisely with the priming cap 18 by the guide opening 20 and is held in that position.

Figure 2:
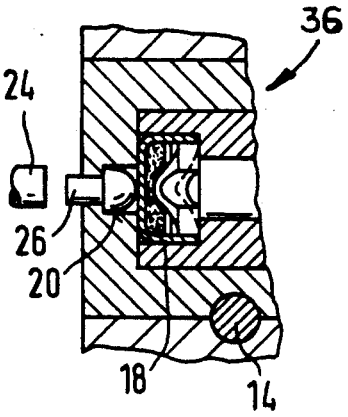
FIG. 2 is a partial view of another embodiment of the gas generator.

FIG. 2 shows an embodiment having an impact transmission element which is not formed as ball but as pin 26. The pin 26 comprises at its end opposite the priming cap 18 a widened and rounded head which is received in a widening of the guide opening 20. The end of the pin 26 remote from the priming cap 18 projects out of the guide opening 20, which is formed as step bore to secure the pin 26 in the interior thereof. The end surface area of the striking member 24 is substantially greater than the end surface area of the pin 26. In this embodiment as well, for activating the gas generator 36, a striking member 24 is driven with its blunt end against the end of the impact transmission element, i.e. the pin 26, projecting out of the guide opening 20.

Figure 3:
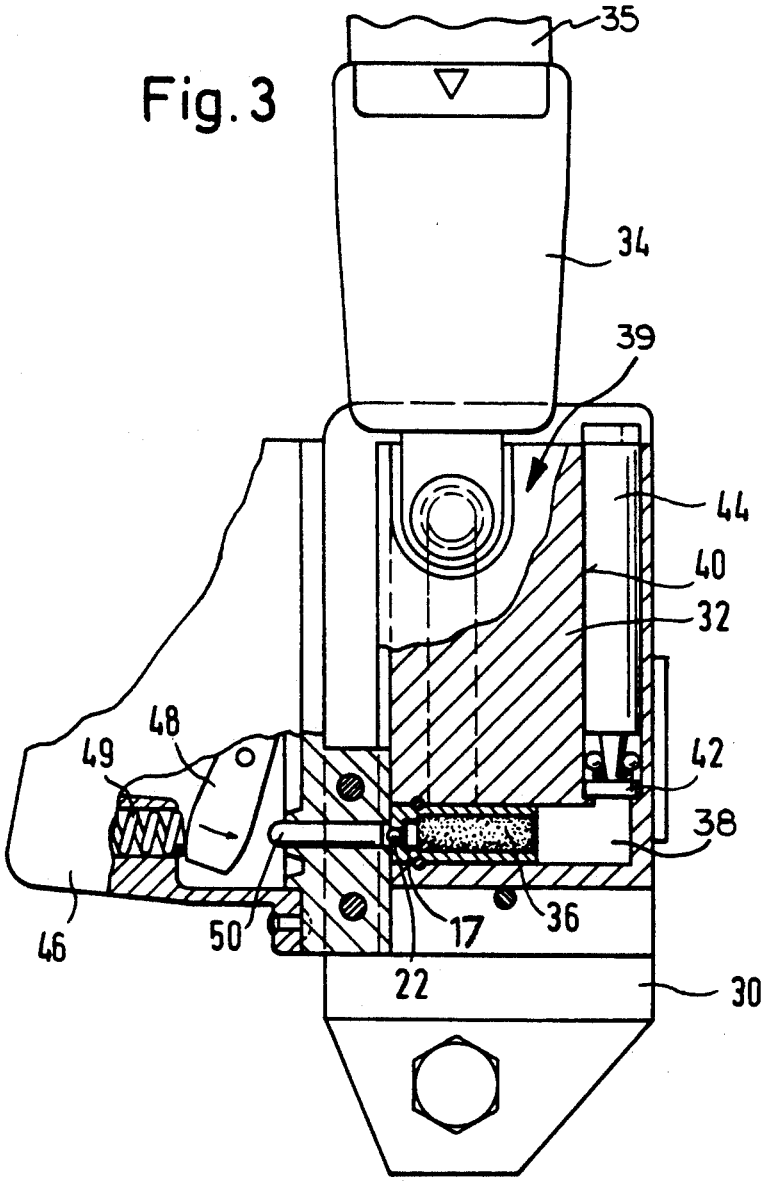
FIG. 3 is a schematic partially sectioned view of a safety belt pretensioner having a percussion igniter according to the invention.

FIG. 3 shows the use of a gas generator of the type shown in FIG. 1 in a belt pretensioner of a safety belt system 28 for vehicles. A cylinder block 32 is displaceably guided in the direction towards the vehicle floor on a fitting 30 which is dimensioned to bear loads and is screwed to the vehicle bodywork. A buckle 34 retains a belt 35 via a mechanism (not shown). The buckle 34 of the safety belt system 28 is anchored to the cylinder block 32. The gas generator 36 constructed analogously to FIG. 1, is accommodated in a chamber 38 of the cylinder block 32. The cylinder block 32 carries the gas generator 36. Thus, the cylinder block 32, the gas generator 36 and the buckle 34 define an assembly 39 which is movable relative to the fitting 30. A piston 42 connected via a rigid piston rod 44 to the fitting 30 is accommodated in a cylinder bore 40 of the cylinder block 32. A vehicle-sensitive trigger mechanism 46 is secured to the fitting 30. It includes a pivotally mounted impact member 48 which is movable under the action of a pressure spring 49 against the one end of a striking pin 50 which is received in a cylindrical guide bore and the other end of which lies directly opposite the ball 22 of the gas generator 36. The striking pin 50 thus corresponds to the striking member 24 indicated in FIG. 1. The fitting 30, the vehicle sensitive trigger mechanism 46 and the striking pin 50 define an assembly 51. The assembly 39 is movable relative to the assembly 51. The pivotal impact member 48 is restrained in its rest position shown in FIG. 3 by a detent mechanism (not illustrated). The restraint of the impact member 48 is overcome due to movement of a vehicle-sensitive mass so that said impact member 48 is driven by the biased spring 49 against the adjacent end of the striking pin 50. The striking pin 50, with its blunt end, strikes the ball 22 and drives the ball 22 into the priming cap 18 of the percussion igniter 17 carried by the cylinder block 32. The gas generator 36 is ignited; the gases generated by it are supplied through the chamber 38 of the cylinder bore 40 and drive the cylinder block 32, since the piston 42 is fixed to the fitting 30, in the direction towards the vehicle floor, the buckle 34 being entrained and the belt slack taken out of the safety belt system.

I claim:

1. A pyrotechnical gas generator in a safety belt system for vehicles having a belt pretensioner, comprising a housing and a priming cap, said housing having a guide opening, an impact transmission element being accommodated in said guide opening of said gas generator housing opposite an impact surface of said priming cap and having a free end projecting out of said guide opening with a predetermined cross-sectional area, said free end of said impact transmission element being arranged opposite a striking member, said striking member having a striking area opposite said free end of the impact transmission element which is substantially greater than the cross-sectional area of said free end, each of said gas generator and said striking member being arranged in a respective one of two assemblies of said belt pretensioner in said safety belt system, and said assemblies being movable with respect to each other.

2. The pyrotechnical gas generator according to claim 1, wherein said gas generator is connected with a buckle of the safety belt system, said gas generator and said buckle forming said first assembly, said striking member being arranged in a fitting in which the first assembly is movable, and said striking member and said fitting forming said second assembly.

3. The pyrotechnical gas generator according to claim 1, wherein said impact transmission element is a ball.

4. The pyrotechnical gas generator according to claim 3, wherein said guide opening is narrowed at an outer end thereof and said ball is held by said narrowed outer end of said guide opening.

5. The pyrotechnical gas generator according to claim 1, wherein said impact transmission element is a pin.

6. The pyrotechnical gas generator according to claim 5, wherein said pin is rounded at an inner end thereof disposed opposite said priming cap.

7. The pyrotechnical gas generator according to claim 5, wherein said guide opening is formed by a stepped bore with an inner section of relatively larger diameter, said pin having a headpiece received in said inner bore section.

8. A safety belt system in a vehicle, said system comprising:

a buckle means for retaining a belt which restrains a vehicle occupant;

a fitting means for anchoring said system to the vehicle, said fitting means being connected to a body portion of the vehicle;

a block means for moving said buckle means to reduce slack in the belt, said block means being connected to said buckle means, said block means being constrained by said fitting means to permit movement of said block means from a first position to a second position, said block means moving said buckle means to reduce slack in the belt during movement of said block means from said first position to said second position;

means for moving said block means from said first position to said second position, said means including a gas generating means for providing gas under pressure to force said block means to move from said first position to said second position upon activation of said gas generating means, said gas generating means including a percussion igniter means for igniting said gas generating means, said percussion igniter means including an impact transmission member and a priming cap, said impact transmission member impacting on said priming cap upon said impact transmission member being struck, said gas generating means being carried by said block means for movement relative to said fitting means; and trigger means for activating said gas generating means in response to a predetermined vehicle condition, said trigger means including strike means for striking said impact transmission member of said percussion igniter means, said trigger means being carried by said fitting means, said block means and said gas generator means being movable relative to said strike means.

9. A safety belt system as set forth in claim 8, wherein said gas generating means includes a housing, said housing having a bore, said percussion igniter means including said priming cap, said percussion igniter means including a part, said part being located partially within said bore and partially outside of said bore, said part being movable along said bore to impact against said priming cap.

10. A safety belt system as set forth in claim 9, wherein said strike means having a blunt end surface area for striking a portion of said part to move said part to impact against said priming cap, said blunt end surface area being substantially greater than the surface area of said portion of said part.

11. A safety belt system as set forth in claim 10, wherein said part is a ball.

12. A safety belt system as set forth in claim 11, wherein said bore being narrowed at an outer end, said ball being retained by said narrowed outer end.

13. A safety belt system as set forth in claim 10, wherein said part is a pin.

14. A safety belt system as set forth in claim 13, wherein said pin is rounded at an inner end which is disposed opposite said priming cap.

15. A safety belt system as set forth in claim 13, wherein said bore is a stepped bore.

16. A safety belt system as set forth in claim 8, wherein said block means having a bore, a pretensioner means including a piston means which extends into said bore, said piston means being connected to said fitting means, said gas generating means providing gas for applying force to said piston means to move said piston means relative to said block means.

* * * * *